US007600366B2

(12) United States Patent
Furukawa et al.

(10) Patent No.: US 7,600,366 B2
(45) Date of Patent: Oct. 13, 2009

(54) WIRE ROPE FOR RUNNING WIRE

(75) Inventors: Ippei Furukawa, Kasumigaura (JP); Shuji Ida, Kasumigaura (JP)

(73) Assignee: Tokyo Rope Manufacturing Co., Ltd., Tokyo (JP)

( * ) Notice: Subject to any disclaimer, the term of this patent is extended or adjusted under 35 U.S.C. 154(b) by 0 days.

(21) Appl. No.: 11/969,621

(22) Filed: Jan. 4, 2008

(65) Prior Publication Data

US 2008/0236130 A1 Oct. 2, 2008

(30) Foreign Application Priority Data

Mar. 30, 2007 (JP) ..... 2007-090569

(51) Int. Cl.
*D02G 3/02* (2006.01)

(52) U.S. Cl. ..... 57/212; 57/218

(58) Field of Classification Search ..... 57/212, 57/214, 218, 231, 236, 237
See application file for complete search history.

(56) References Cited

U.S. PATENT DOCUMENTS 4,509,319 A * 4/1985 Yoshida et al. ..... 57/218
5,669,214 A * 9/1997 Kopanakis ..... 57/218
6,360,522 B1 3/2002 Walton
7,036,298 B2 * 5/2006 Honda ..... 57/214
7,401,961 B2 * 7/2008 Longatti et al. ..... 362/551

FOREIGN PATENT DOCUMENTS

JP 63-46196 12/1994
JP 2876140 1/1999
JP 3493248 11/2003

* cited by examiner

*Primary Examiner*—Shaun R Hurley
(74) *Attorney, Agent, or Firm*—Michael J. Striker

(57) ABSTRACT

A wire rope for a running wire, has a core rope, a plurality of side strands arranged at an outer periphery of the core rope to be twisted together therewith, and a resin spacer interposed between the side strands, the core rope including a core rope main body composed of a plurality of wires and a resin coating layer outwardly surrounding the core rope main body so that the resin coating layer separates the core rope main body from the side strands, each of the side strands being composed of a plurality of further wires, and the resin spacer being provided with contour corresponding to an outer layer of the further wires of the side strands and extending between the wires of the outer layer of the side strands.

7 Claims, 5 Drawing Sheets

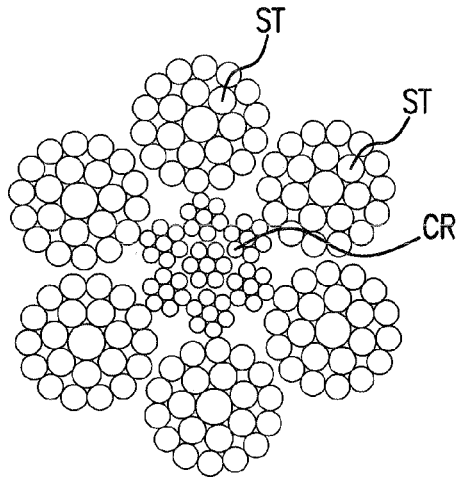
FIG. 1
(PRIOR ART)
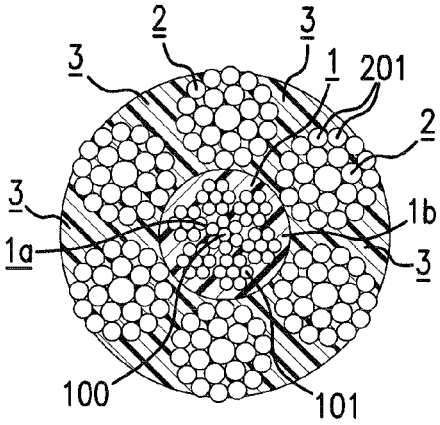
FIG. 2-A
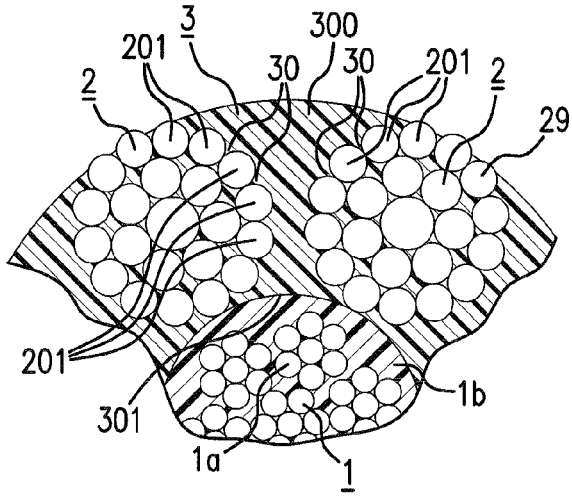
FIG. 2-B

Fig.3-A
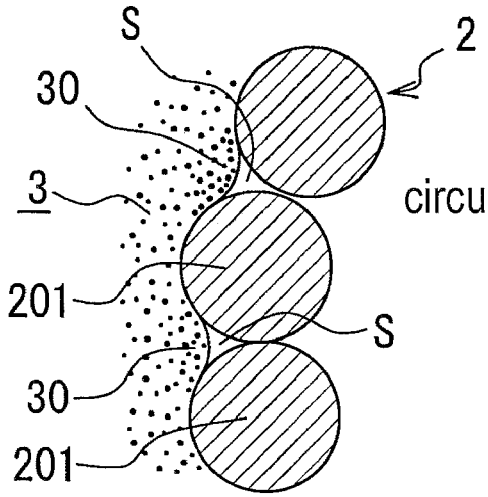
Fig.3-B
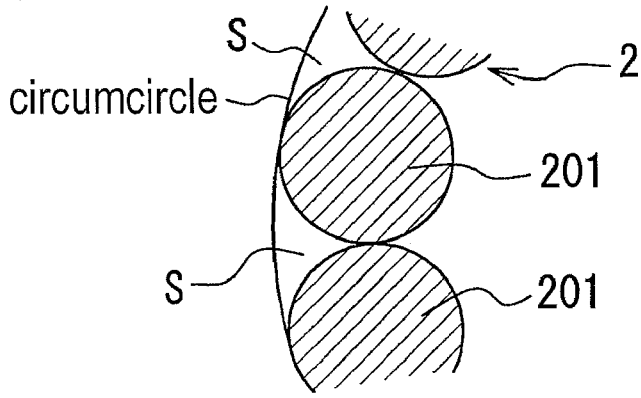
Fig.4-A
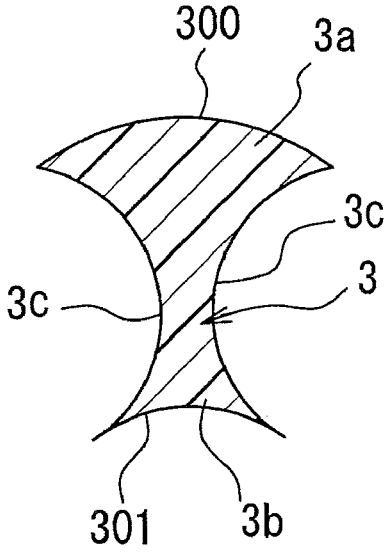
Fig.4-B
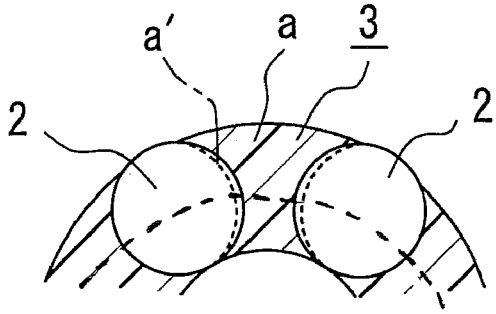

WIRE ROPE FOR RUNNING WIRE

CROSS-REFERENCE TO RELATED APPLICATION

The invention described and claimed hereinbelow is also described in Japanese Patent Application JP 2007-090569 filed on Mar. 30, 2007. This Japanese Patent Application provides the basis for a claim of priority of invention under 35 U.S.C. 119(a)-(d).

TECHNICAL FIELD

The present invention relates to an improvement in a wire rope for a running wire.

BACKGROUND ART

There are many wire ropes. It is well known that when a wire rope is used, unless a wire rope is adapted to an object thereof and a place of use is selected, an advantage provided by a wire rope cannot sufficiently be utilized.

Particularly, a wire rope for a running wire in a crane or the like is bent by a sheave and is wound to a drum. Therefore it must have an adequate fatigue resistance.

A rope of this kind is known in the prior art, as shown by FIG. 1. It has a plurality of pieces of side strands ST at an outer periphery of a core rope CR to be twisted, and a fiber core or a metal core is used for the core rope. Because of this structure, metal contact is unavoidable between the strands, and between a sheave portion and the rope thus causing wear of the rope.

Although a number of ropes have been proposed as a countermeasure thereagainst in the prior art, problems posed by the respective prior arts cannot be construed as sufficiently resolved.

According to Japanese Patent No. 2876140 (Prior Art 1), a core rope is thinly coated with a resin while wear between the core rope and a side strand can be avoided, wear between and at a contact face with a sheave cannot be avoided.

It is described in Japanese Patent No. 3493248 (Prior Art 2) that a spacer made of a resin is provided between side strands and an angle of an apex of the spacer is 60 degrees as considered in an outer peripheral direction. However a base end portion of the spacer is formed by a wedge-like shape, the wedge portion reaches a center of the rope, and therefore, an effective sectional area of the rope is reduced so that it is difficult to use the rope for an application that involves a high breaking load.

JP-B-63-46196 (Prior Art 3) discloses a filling member forming a diverging portion by a constriction with a front end having a fan-like shape and interposed between side strands. However, a reinforcement core is provided for a filling material, and therefore the filling material does not extend between wires constituting the side strand. Also, when the reinforcement core is disconnected at an early stage, there is a possibility of jumping out the reinforcement core from the filling material. Furthermore, since the reinforcement core is provided for the filling material, a special equipment is needed for fabrication thereof at increased cost.

U.S. Pat. No. 6,360,522 (Prior Art 4) discloses a rope that is similar to the rope of Prior Art 3. A spacer is formed with a diverging portion by a constriction with a front end of a fan-like shape oriented between side strands. However, here a resin having a high strength of a biaxially oriented molecular structure or the like is used, and therefore, the spacer is difficult to be deformed and does not extend between wires constituting a side strand. Therefore the wire can move and a wire breakage at a point of contact with a core rope cannot be restrained and elongation of the rope is increased.

SUMMARY OF THE INVENTION

The invention has been carried out in order to resolve the above-described problems. It is an object of the present invention to provide a wire rope for a running wire capable of increasing a surface life by reducing a wire breakage at a point of contact with a core rope by constraining a movement of a wire in a rope filled with a resin member between strands and reducing an elongation thereof.

In order to achieve the above-described object, in accordance with the invention a rope has a core rope and a plurality of side strands arranged at an outer-periphery thereof to be twisted together therewith, and a resin spacer is interposed between the side strands, wherein the core rope includes a core rope main body and a resin coating layer outwardly surrounding the core rope main body, the core rope main body and the side strand are separated from each other by the resin coating layer, and the resin spacer is provided with a contour in correspondence with an outer layer wire of the side strand and extends between the outer layer side wires.

According to the invention, the core rope includes the core rope main body and the resin coating layer outwardly surrounding the core rope main body, the core rope main body and the side strand are separated from each other by the resin coating layer, and therefore, metal contact between the side strand and the core rope is prevented, and a wire breakage at a point of being contacted to the core rope can considerably be reduced. Further, by interposing the resin spacer between the strands, contact between the strands is prevented, a wire breakage at a valley of a rope between respective strands is prevented, a face pressure of a surface of the rope is reduced by increasing a portion thereof in contact with the sheave, and service life because of preventing a wire breakage at a crown of the strand in contact with the sheave by wear can considerably be prolonged. Further, the resin spacer is provided with the contour in correspondence with the outer layer wire of the side strand and extends between the outer layer wires, and therefore, the movement of the wire is constrained, an excellent effect of reducing the wire breakage at the point of contact with the core rope and of reducing an elongation of the rope is achieved.

According to a preferable embodiment of the invention, the resin spacer extends between the wires by a filling rate equal to or larger than 50%. Further preferably, the filling rate is equal to or larger than 60%. Here, filling rate=area (A) of the resin extending between the wires/area (B) of a gap between a circumcircle of the strand and an outermost layer wire×100.

A degree of extension of the resin between the wires is high, and therefore, the movement of the wire can stopped, because when the rope is bent by the sheave, the movement of the wire is firmly restrained, the wire breakage at the point of contact with the core rope is insignificant, and the service life is extended. Further, the elongation can be reduced.

Preferably, the resin spacer comprises a streak member formed by subjecting a thermoplastic resin selected from any of polypropylene species, polyethylene species, acrylic species, polyurethane species to extrusion molding, the streak member is provided with a sectional shape in which a head portion enlarged in a fan-like shape and a base portion in a fan-like shape smaller than the head portion are made to be continuous by a constriction edge. A thickness between the constriction edges is constituted by a value increasing a gap of arranging the side strands on layer cores by 15 through 30%, that is, when the gap of arranging the side strands is 100, the thickness is 115 through 130%.

The streak member is plastically deformed by being compressed from an outer periphery thereof and is arranged between the strands so that the resin spacer is filled between the wires to engage the wires. The resin spacer is provided with a press-fit filling portion exceeding the circumcircle of the side strands to fill the gap between the outer layer side wires at a side edge portion thereof, and the press-fit filling portion is constituted by a converging mountain shape on a front side of a bent portion along a contour of the outer layer side wire.

Thereby, the movement of the wire when the rope is bent is firmly restrained, the wire breakage at the point of contact with the core rope is very insignificant, and the elongation can be reduced.

Although other features and advantages of the invention will become apparent by the following detailed explanation and a description of the drawings, the invention is not limited to a constitution shown in the embodiment so far as a basic characteristic of the invention is provided.

BRIEF DESCRIPTION OF THE DRAWINGS

FIG. 1 is a sectional view of a wire rope for a running wire of a background art.

FIG. 2-A is a sectional view showing an embodiment of a wire rope for a running wire according to the invention.

FIG. 2-B is a partially enlarged view of FIG. 2-A.

FIG. 3-A schematically shows an interwire resin filling rate according to the invention and is a sectional view of a resin between wires.

FIG. 3-B is a sectional view showing a gap between a circumcircle of a strand and a wire of the outermost layer.

FIG. 4-A is an enlarged sectional view showing an example of a resin spacer to be positioned between wires.

FIG. 4-B is a schematic view showing a relationship between a gap between wires and a size of a resin spacer.

DESCRIPTION OF THE PREFERRED EMBODIMENTS

Figure 5:
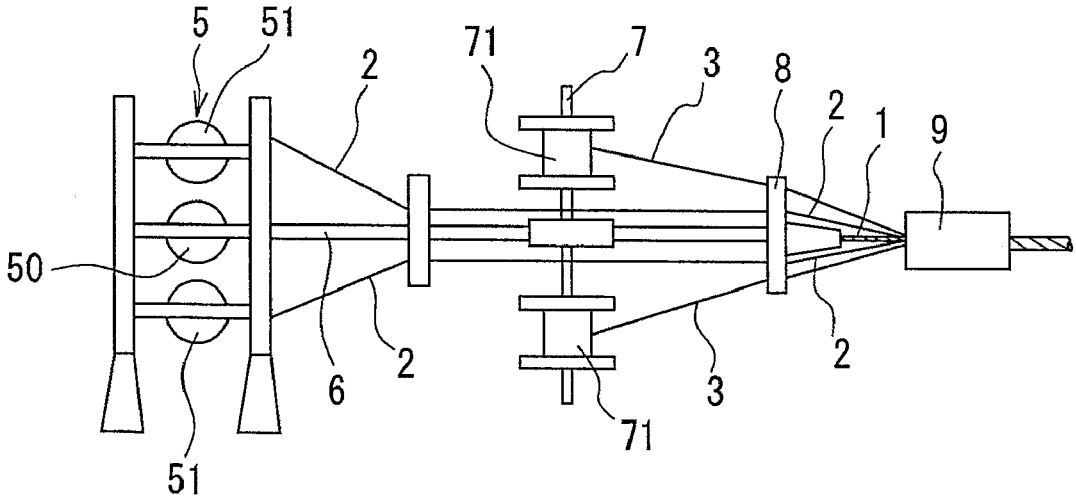
FIG. 5 is an explanatory view showing a step and an apparatus of closing a rope according to the invention.
Figure 6:
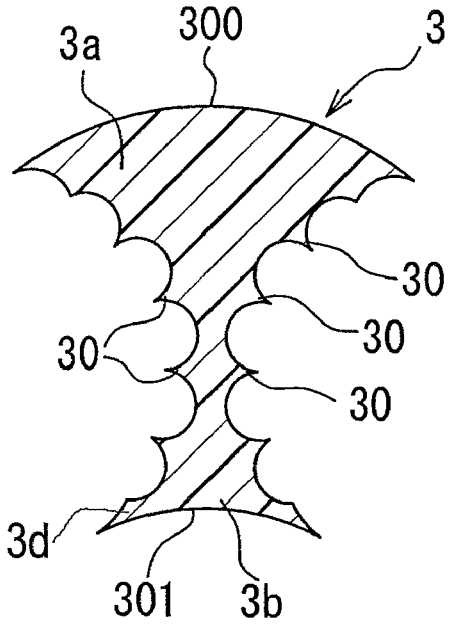
FIG. 6 is a sectional view showing a shape of a resin spacer after closing.

An embodiment of the invention will be explained in reference to the attached drawings as follows.

FIGS. 2-A, B and FIGS. 3-A, B show an embodiment of a wire rope for a running wire according to the invention, which is constituted by a core rope 1, a plurality of pieces of side strands 2, and a resin spacer 3 interposed between the strands 2.

The core rope 1 is provided with a resin coating layer 1*b* to incorporate a core rope main body 1*a* constituted by twisting steel wires or strands. The core rope 1 is larger than an outer diameter of the side strand 2.

Although a structure of the core rope main body is arbitrary, according to the example, the core rope main body comprises IWRC of 7×7 in which at a surrounding of a core member 100 of 1×7 structure, 6 pieces of side members 101 having the same structure are arranged to twist. The resin coating layer 1*b* is provided with a thickness sufficiently exceeding a circumcircle of the core rope main body 1*a* in order to prevent the side strand 2 and the core rope main body 1*a* from being brought into direct contact with each other. Although the resin coating layer 1*b* has a circular shape in this example, depending on cases, in order to improve to settle the side strand, a spiral groove having a pitch equal to a pitch of twisting a rope may be provided at an outer periphery thereof. It is preferable that the spiral groove is provided with a depth and a width capable of making at least 1 piece of a wire at an outer layer of the side strand 2 falls thereinto.

A plurality of pieces (6 pieces in the drawing) of the side strands 2 are used. Although a structure of each side strand 2 is arbitrary, according to the example, the side strand 2 is constituted by a structure of 6×Fi (29). That is, the side strands 2 are formed so that 7 pieces of relatively slender wires are arranged at a surrounding of a core wire, a total of 7 pieces of slender diameter wires are arranged at respective valleys between the slender wires to twist to constitute the inner layer, and 14 pieces of outer layer side wires 201 are arranged to twist at a surrounding thereof.

Steel wires are used for the respective wires of the core rope 1 and the side strand 2. When a high strength is required for a rope, a steel wire having a characteristic of a tensile strength of 240 kg/cm$^2$ or higher is used. Such a steel wire is provided by drawing a raw material wire having a carbon content equal to or larger than 0.70 wt %. The wire can have a thin corrosion resistant coating, for example, zinc plating, zinc/aluminum alloy plating or the like at a surface thereof. A diameter of the wire is selected to be able to withstand a fatigue due to repeated bending by a sheave.

The respective side strands 2 are arranged at equal intervals at an outer periphery of the resin coating layer 1*b* of the core rope 1, the resin spacers 3 are inserted at respective intervals of the respective side strands 2 and twisted together along with the side strands 2.

A streak member produced by extruding a thermoplastic resin is used for the resin spacer 3. Although polypropylene, polyethylene are generally used for a thermoplastic resin, a thermoplastic resin which is provided with a pertinent elasticity for adjusting a friction coefficient between the thermoplastic resin and a sheave and having a comparatively high friction coefficient, is not hydrolyzed and has in addition to wear resistance, weather resistance, flexibility (stress crack resistance), for example, acrylic species, polyurethane species (ether spices polyurethane or elastomer thereof) or the like is also preferable.

Further, a resin of the resin coating layer 1*b* of the core rope 1 can be a resin having an excellent adherence with a core rope main body 1*a* of polyvinyl chloride, nylon, polyester, polyethylene, polypropylene and copolymers of the resins. However, it is preferable that resins are the same or similar in physical, chemical properties, and therefore, it is preferable when the resin of the resin coating layer 1*b* is the same as or similar to the resin of the resin spacer 3.

As shown in FIG. 4-A, the resin spacer 3 is provided with a head portion 3*a* enlarged in a fan-like shape and a base portion 3*b* in a fan-like shape smaller than the head portion. They are made to be continuous by constriction edges 3*c*, 3*c* as a single member.

As shown by FIG. 4-B, the resin spacer 3 is provided with a sectional area a pertinently larger than a sectional area a of an interval between the side strands 2. This is realized specifically by using a thickness between the constriction edges 3*c*, 3*c* with value constituted by increasing a gap of arranging the side strands on a layer center by, for example, 15 though 30%.

The resin spacers 3 are inserted at respective intervals between the respective side strands 2 and twisted together along with the side strands 2. A radius of curvature of a top face 300 of the head portion 3*a* of the resin spacer 3 substantially coincides with a circumcircle of the rope, and a radius of curvature of a bottom face 301 is brought into close contact with the resin coating layer 1*b* of the core rope 1.

As show by FIG. 2-B, the resin spacer 3 in the state of being twisted together includes a press-fit filling portion 30 exceeding the circumcircle of the side strand 2 and bridging a gap between the respective outer layer side wires 201, 201, to constitute a converging mountain shape on a front side of a bent portion along a contour of the outer layer side wire 201 at a side edge portion thereof.

Here, a size of the press-fit filling portion 30 is expressed by a filling rate. As shown schematically in FIG. 3-A, when an area of the press-fit filling portion 30 extending between the outer layer side wires 201, 201 is designated by notation A, and an area of a gap S between the circumcircle of the side strands 2 and the outer layer side wires 201, 201 is designated by notation B, the filling rate is defined as A/B×100(%).

According to the invention, the interwire filling rate is selected to be equal to or larger than 50%, preferably, equal to or larger than 60%. The reason is that when the interwire filling rate is less than 50%, the wire 201 is fixed incompletely, and when the rope is wound around a sheave, a movement of the wire 201 cannot be restrained, and therefore, disconnection, particularly a wire breakage at a point of contact with a core rope cannot sufficiently be reduced. Further, because a force of constraining the wire is small, an elongation of the rope cannot sufficiently be reduced. Further, an upper limit of the interwire filling rate is about 99%.

A structure of the core rope main body la, and a structure of the side, strand 2 are not particularly limited. The core rope main body la may be constituted by IWRC of 7×7, the side strand 2 may be constituted by a structure of S (19), a total of the rope may be constituted by IWRC 8×Sx (19), the core rope main body 1*a* and the side strand may be constituted by 1×7 structure and the total of the rope may be constituted by 7×7 structure.

As for a method of fabricating the wire rope of the embodiment, the core rope 1 having the resin coating layer 1*b* is fabricated by continuously passing the core rope main body 1*a* through a resin extruder. Further, a necessary number of pieces of the side strands 2 are fabricated. On the other hand, the resin spacer 3 having the sectional area larger than the gap between the side strands 2, 2 is fabricated as described above by an extruding mold machine.

Next, these are twisted together into a rope during closing as shown by FIG. 5. In FIG. 5, numeral 5 designates a reel out portion, a bobbin 50 wound with the core rope 1 is arranged at a center portion, and bobbins 51 wound with the side strands 2 are arranged on outer sides. A pipe shaft 6 is extended from the reel out portion 5 in a downstream direction, a horn 7 is rotatably mounted thereto, and the horn is arranged with bobbins 71 wound with the resin spacer 3.

An end cover 8 is fixed to a vicinity of a front end of the pipe shaft 6, the end cover 8 is provided with a hole for inserting the core rope 1 at a center thereof, holes for inserting the side strands 2, and holes for inserting the resin spacer 3 are alternately provided at equal intervals at an outer periphery thereof. Further, a vise 9 for exerting a compression force from a radial direction is disposed on a downstream side of the end cover 8.

When the core rope 1, the side strands 2 and the resin spacer 3 are passed through the end cover 8 while rotating the end cover 8 to be guided to the vise 9, the respective side strands 2, 2 are arranged at the outer periphery of the resin coating layer 1*b*, the resin spacers 3 are inserted to between the side strands 2, 2 and are fixed together with the rope while maintaining the state.

Further, since the vise 9 exerts the compression force to the rope in the radial direction, not only the resin spacer 3 having the sectional area larger than the gap between the side strands 2, 2 intentionally is brought into contact with the circumcircles of the respective side strands 2, 2, but also an extraneous amount of the sectional area is made to flow to between the outer layer side wires 201, 201 of the side strand 2 as shown by FIG. 3-A by plastic deformation and cured to constitute the press-fit filling portion 30.

In the rope produced in this way, in view of a relationship in which the core rope 1 is provided with the resin coating layer 1*b*, a diameter of the core rope 1 is increased by that amount, the gap between the side strands 2 is easy to be formed, and further, the side strand 2 and the core rope 1 are substantially separated by the resin coating layer 1*b*. Therefore, metal contact between the side strands 2 and the core rope 1 is prevented and the wire breakage at the point of contact with the core rope is considerably reduced.

Further, the resin spacer 3 is interposed between the side strands 2, the side strands 2 are completely separated, and therefore, contact between the strands is prevented, and a wire breakage at a valley of the rope between the respective strands is prevented. The base portion 3*b* of the resin spacer 3 extends up to the resin coating layer 1*b* of the core rope 1 and does not reach the rope core, and therefore, also a steel member filling rate can be increased, and the rope strength can be improved. The outer face of the resin spacer 3 substantially coincides with the circumcircle of the rope, and therefore, a face pressure of the surface of the rope is reduced. Service life in view of avoided wire breakage at a crown of the strand contacting with the sheave can be prolonged.

Further, the resin spacer 3 is not only interposed between the side strands but also bridges the gap between the wires 201, 201 constituting the outermost layer of the side strand 2 to fill the gap by the resin, and is brought into contact with the wires 201 and has a resistance against a shift. Therefore, the movement of the wire 201 is restrained, and therefore, the wire breakage at a point of contact with the core rope is reduced.

Figure 7:
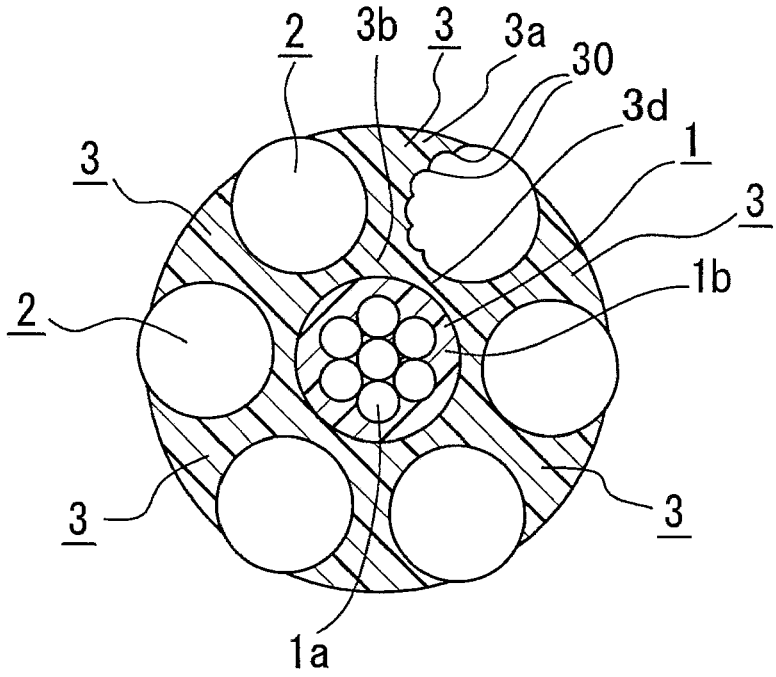
FIG. 7 is a sectional view showing another embodiment of the invention in which a side strand is schematically shown by a circular shape.

FIG. 7 shows a second embodiment of the invention, in which the base portion 3*b* of the resin spacer 3 is provided with a trapezoidal portion 3*d*, and a resin layer is formed between the circumcircle of the side strand 2 and the resin coating layer 1*b* of the core rope 1 by the trapezoidal portion 3*d*. According thereto, the metal contact between the side strand 2 and the core rope 1 is further prevented.

The other embodiment is similar to that of the first embodiment, and therefore, the explanation of the first embodiment will be applied thereto.

EXAMPLES

A rope is fabricated having a structure of IWRC 6×Fi (29) shown in FIG. 2-A, having 0/0, diameter 16 mm, a tensile strength 173 kN. There is used a core rope having a diameter 7.5 mm coated with polypropylene resin by an extruding mold machine at an outer periphery of a core rope main body. 6 pieces of side strands having a diameter of 5.01 mm are used.

A resin spacer is a streak member formed by subjecting polypropylene resin to extrusion molding. The resin spacer is provided with a sectional shape shown in FIG. 4-A, and when a gap of arranging wire cores of the side strands is constituted by 100, a thickness thereof is constituted by a dimension of 125% thereof. The resin spacer is inserted between the side strands by the method of FIG. 5 and is plastically deformed by exerting a compression force in a radial direction by a vise. In order to determine a preferable condition, a radial direction compression degree is changed by varying an inner diameter of the vise to provide ropes of examples 1 through 4 having the interwire filling rates of 10%, 35%, 60% and 95%.

Figure 8:
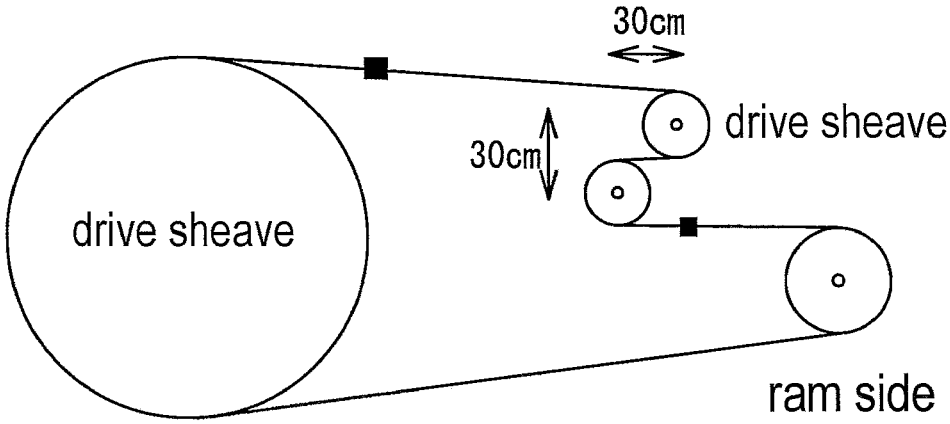
FIG. 8 is an explanatory view of equipment used for a fatigue test.

There is carried out a fatigue test for endlessly connecting the examples 1 through 4, and winding the examples 1 through 4 around a drive sheave and a ram side sheave by two test sheaves having U grooves, middle phases of which are shifted from each other by 30 cm, and reciprocating the examples 1 through 4 as shown by FIG. 8. With a diameter D of the test sheave and a rope diameter d, D/d=20, SF=6 (28.8 kN).

For comparison, the fatigue test is carried out also with regard to a rope shown in FIG. 1 (comparative example 1) and a rope constituted by arranging and twisting side strands around the coated core rope (comparative example 2), and a relationship between a cycle number and a number of disconnection at interval of 1 pitch is investigated.

Figure 9:
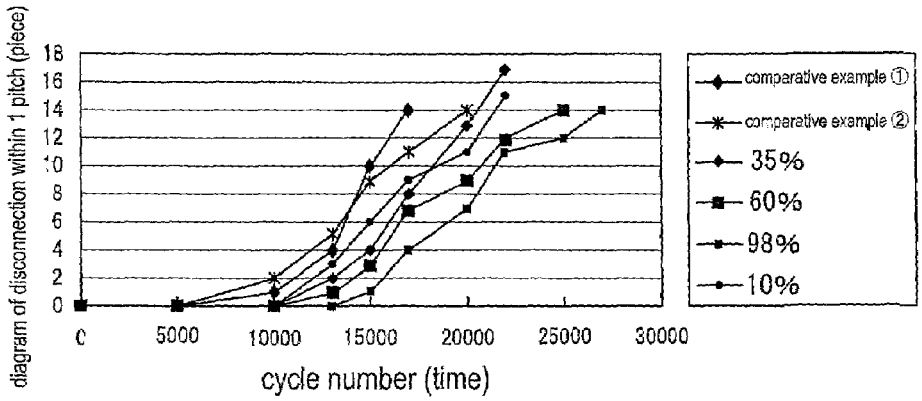
FIG. 9 is a diagram showing a result of a fatigue test of a rope according to the invention and a compared rope.

A result is shown by FIG. 9, service life of example 1 through 4 interposed with the resin spacer 3 is longer than that of comparative examples 1, 2. The result is derived from a reduction in the wire breakage at a crown of the strand contacting with the sheave, and it is shown that an excellent result is achieved particularly when the interwire filling rate is equal to or larger than 60%.

Next, a situation of disconnection at respective portions is investigated by disassembling the respective ropes. A result thereof is shown in Table 1.

TABLE 1

| sample | cycle | strand | | | IWRC |
|---|---|---|---|---|---|
| | | mountain | valley | core rope contact | |
| comparative example ① | 1.7 × 104 times | 11 | 15 | 65 | 82 |
| comparative example ② | 2.0 × 104 times | 20 | 5 | 15 | 4 |
| invented example 1 10% | 2.2 × 104 times | 29 | 0 | 33 | 8 |
| invented example 2 35% | 2.2 × 104 times | 27 | 0 | 32 | 4 |
| invented example 3 60% | 2.5 × 104 times | 28 | 0 | 10 | 6 |
| invented example 4 98% | 2.7 × 104 times | 35 | 0 | 3 | 5 |

In Table 1, the comparative example 2 is provided with the resin coating at the core rope, and therefore, the wire breakage at the point of contacting with the core rope is insignificant in comparison with comparative example 1 and also disconnection of the core rope main body is insignificant. However, the wire breakage at the valley of the rope between respective strands is considerable. In contrast thereto, when the interwire filling rate is increased by using the resin spacer, the cycle number is increased and the wire breakage at the valley of the rope to respective strands and the wire breakage at the point of contacting with the core rope are considerably reduced. This is because the movement of the wire is fixed by press-fitting the resin between the wires, and therefore, the movement of the wire when bent by the sheave is effectively restrained.

Next, Table 2 shows a result of measuring elongation (%) for respective ropes.

TABLE 2

| cycle | comparative example | | invented example | | | |
|---|---|---|---|---|---|---|
| (time) | ① | ② | 10% | 35% | 60% | 98% |
| 17000 | 0.5 | 0.3 | 0.35 | 0.28 | 0.19 | 0.16 |
| 20000 | — | 0.33 | 0.38 | 0.32 | 0.23 | 0.17 |
| 22000 | — | — | 0.42 | 0.35 | 0.25 | 0.2 |
| 27000 | — | — | — | — | — | 0.23 |

As is apparent from the result, when the interwire filling rate is increased by using the resin spacer, the elongation is reduced, which can be regarded as the pertinent property for a rope used in a materials handling equipment of a crane or the like.

The invention claimed is:

1. A wire rope for a running wire, comprising a core rope; a plurality of side strands arranged at an outer periphery of said core rope to be twisted together therewith; and a resin spacer interposed between said side strands, said core rope including a core rope main body composed of a plurality of wires and a resin coating layer outwardly surrounding said core rope main body so that said resin coating layer separates said core rope main body from said side strands, each of said side strands being composed of a plurality of further wires, and said resin spacer being provided with contour corresponding to an outer layer of the plurality of said further wires of each said side strands and extending between said further wires of said outer layer of said side strands.

2. A wire rope for a running wire as defined in claim 1, wherein said resin spacer is configured as an extrusion molded streak member composed of a thermal plastic resin selected from the group consisting of polypropylene species, polyethylene species, acrylic species, and polyurethane species.

3. A wire rope for a running wire as defined in claim 1, wherein said resin spacer has a sectional shape in which a head portion enlarged in a fan-like shape and a base portion in a fan-like shape smaller than the said head portion are provided to be continuous by a constriction edge, and a thickness among the constriction edges is constricted by a value increasing a gap of arranging said side strands on layer cores by 15 through 30%.

4. A wire rope for a running wire as defined in claim 1, wherein said resin spacer has two opposite sides facing neighboring two of said side strands and each provided with a plurality of recesses accommodating the plurality of said further wires of a respective one of said neighboring strands and separated from each other by filling portions extending between the plurality of said further wires of said side strands.

5. A wire rope for a running wire as defined in claim 1, wherein said resin spacer is configured so that it extends between said further wires of said side strands by a filling rate equal to or larger than 50%, said resin spacer including a press-fit filling portion bridging a gap between said further wires of said outer layer of said side strands by exceeding a circumcircle of said side strands at a side edge portion thereof, and the press-fit filling portion constitutes a converging mounting portion on a front side of a band portion along a contour of said outer layer of said further wires of said side strands.

6. A wire rope for a running wire as defined in claim 1, wherein said core rope main body includes a core member composed of a plurality of said wires, and several side members each composed of a plurality of said wires.

7. A method of fabricating a wire rope for a running wire defined in claim 1, comprising the steps of fabricating the core rope having the resin coating layer by continuously passing the core rope main body through a resin extruding machine, and fabricating the resin spacer having a sectional area larger than a gap between the side strands by an extruding mold machine; arranging the respective side strands at an outer periphery of the resin coating layer of the core rope, and inserting the resin spacer between the side strands and twisting together the respective strands and the core rope and the resin spacers into a rope under the state; forming the press-fit filling portion by inserting a compression force to the twisted rope from a radius direction to thereby bringing the resin spacer having a sectional area larger than a gap between the side strands into contact with the circumcircle of the respective side strands, and making an extraneous amount of the sectional area flow between the outer layer side wires of the side strands by plastically deforming the extraneous amount of the sectional area and curing the resin spacer under the state.

* * * * *